United States Patent [19]

Wasson

[11] 3,983,659

[45] Oct. 5, 1976

[54] STATIONARY NOISEMAKING TOY

[75] Inventor: Percy Wasson, Toronto, Canada

[73] Assignee: Lawrence Peska Associates, Inc., New York, N.Y. ; a part interest

[22] Filed: May 8, 1975

[21] Appl. No.: 575,812

[52] U.S. Cl. ..... 46/68

[51] Int. Cl.[2] ..... A63H 1/06

[58] Field of Search ..... 46/68, 66, 174, 179, 46/189, 191

[56] References Cited

UNITED STATES PATENTS

| | | | |
|---|---|---|---|
| 1,239,036 | 9/1917 | Pfeifer | 46/191 |
| 1,292,436 | 1/1919 | Coulombe | 46/191 |
| 1,418,936 | 6/1922 | Kolanowski | 46/66 |
| 2,047,784 | 7/1936 | Krakowski | 46/189 |
| 2,213,915 | 9/1940 | Katz | 46/68 X |
| 3,339,445 | 9/1967 | Fuchs | 46/66 X |

*Primary Examiner*—Louis G. Mancene
*Assistant Examiner*—Jack Q. Lever
*Attorney, Agent, or Firm*—Jack D. Slobod

[57] ABSTRACT

A sounding toy has a stationary, hollow base; a top closure rigidly fixed over the base with an elongated tubular neck portion or sleeve slidably receiving a spring loaded drill rod having a knob at its upper end; and a disc rotated thereby through a one way clutch upon return of the spring at its lower end and positioned in the base. Springs or other noisemaking means in the base produce noise when hit by striking means on the rotating disc.

3 Claims, 4 Drawing Figures

STATIONARY NOISEMAKING TOY

BACKGROUND OF THE INVENTION

1. Field of Invention

This invention relates to a novel sounding toy resembling a musical spinning top. Unlike such a top the present toy does not have a lower part rotated by a driving mechanism and entraining an upper part. The present top also does not have the reeds required for sound production by prior art tops but uses instead spaced springs.

2. Description of the Prior Art

The art to which this invention relates is already aware of the following U.S. Pat. Nos. 2,052,406; 2,809,548; 2,841,920; 3,478,932; 2,997,808; 2,908,108; 2,950,641; and 3,153,968. The tops with musical mechanisms described in these patents all have fairly complex mechanisms perhaps not justified by the care they will eventually get from small children nor by the length of time they will hold the attention of such children. A need would then seem to exist for a less complicated sounding toy which either can be more readily repaired or inexpensive enough to be discarded when damaged.

The principal object of this invention is to provide a device or article of this character which combines simplicity, with inexpensiveness of construction.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

In the accompanying drawing, in which is shown one of the various possible illustrative embodiments of this invention, wherein like reference character identify the same or like parts:

Figure 1:
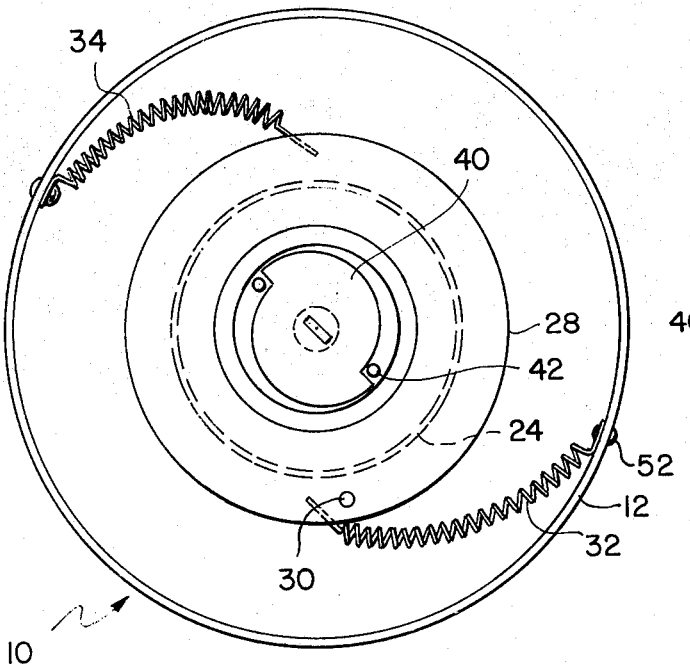
FIG. 1 is a top plan view of the toy with its top and drill rod removed.

With reference to the drawing, there is shown and illustrated a noisemaking toy constructed in accordance with the principles of the invention and designated generally by reference character 10.

Figure 2:
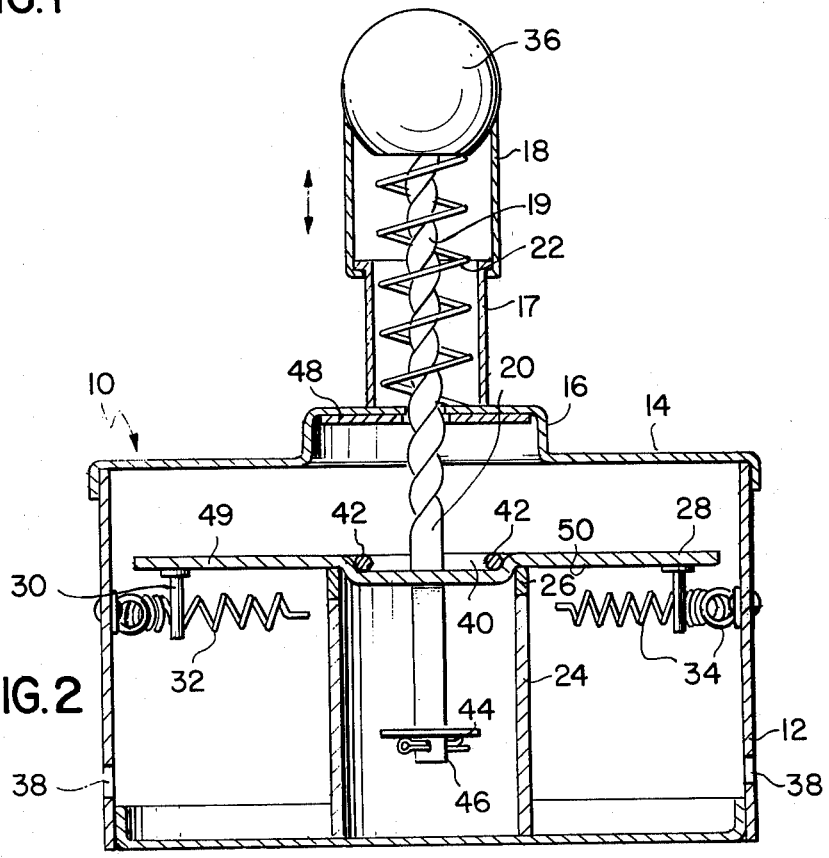
FIG. 2 is a cross-sectional view in elevation of the toy.

Referring to FIG. 2, the novel toy consists of a generally circular hollow base 12 on the open top of which is clamped or otherwise fitted a top closure 14. Top 14 has a central annular member 16 integral therewith with an opening therein and has a vertical hollow sleeve 18 axially movable on sleeve 17. As shown in FIG. 2, sleeves 17–18 house drill rod 20 which is a spiral or twisted at its upper part 19 and rectangular at its lower end 21. Rod 20 is spring loaded by return coiled spring 22 whose lower extremity extends into hollow base 12 and is journalled in support bearing 24 through journals 26. Mounted for rotation with shaft 20 is disc 28 from which depends striking member or striker pin 30.

Figure 4:
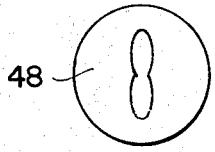
FIG. 4 is a plan view of a disc forming part of the assembly.

A disc 48 is riveted tightly to 14 as shown in FIG. 2. As shown in FIG. 4, the helical hole in 48 is so designed to turn the spiral shaft which should be of a different metal than the shaft to prevent sticking.

Figure 3:
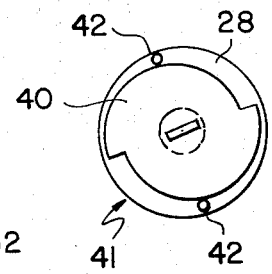
FIG. 3 is a plan view of the clutch mechanism.

As shown in FIGS. 1 and 3, the clutch has disc 41 which is made in two parts. The bottom part 28 is indented to hold eccentric 40 1/16 inch thick × 1 inch diameter. The numeral 42 denotes two small ball bearings approximately ⅛ inch diameter.

The hole in 40 is not squae it is approximate ⅛ inch or 5 mm × ¼ inch mm or 7 mm plus a few .001's for operating clearance and longer life to prevent the corners from wearing off too soon. On FIG. 1 the drawing of 40 shows bearings 42 & 42 in working position, when 36 is being pushed down to rotate 28.

When the knob 36 is pushed down spiral drill rod 20 is rotated pushing 42 against the walls of the race 51 causing a tightening action of 40 against 42 and 28. When rod 20 has finished its downward motion causing a spinning action of 28, spring 22 will raise rod 20 to its starting point and 28 will keep on rotating. As 42 will return to notched position in 40 to allow 28 to spin freely. 44 is a washer on the end of 20 with 46 a cotter pin in hole in 20 to keep 20 from coming out of 24 and causing it to rise too far.

Disc 28 is made of two pieces of metal the top 49 to be larger than bottom 50 to be turned down around the edge to hold them tight together or they can be made the same size and riveted together to hold them rigidly as one piece.

As shown in FIG. 1, a plurality of spring or reed members of which two (32 and 34) are outstretched between the sides of 12 and 24. One end of each spring is riveted to base 12 and are diametrically apposed, the thickness of each spring can be different, so that these when struck will emit a low noise of a different pitch or tone.

The upper end of shaft 20 has knob 36 mounted thereon. Base 12 is of heavier plastic or metal than the rest of the assembly to prevent the toy from tipping over.

Base 12 has a plurality of noise openings 38 in the lower part thereof to attenuate the level thereof below an unpleasant level still audible to the child but less to others further away.

It will be appreciated that instead of the present system various means for converting the vertical motion of drill rod 20 to circular motion can be used. One suitable system is described in U.S. Pat. No. 2,997,808. The novel features of the present toy reside mainly in the provision of springs 32 and 34 stretched between members 12 and 24 and operating as sounding means and the provision of a stable flat base. Such stability is achieved by making member 12 of heavy material and giving it a diameter from 3 to 6 times that of the central elements for a substantially equal height.

A convenient way of manufacturing the present toy is to convert a self-dumping ash tray by adding thereto the driving mechanism associated with conventional spinning toys in addition to the other parts described hereinabove.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

As various possible embodiments might be made of the above invention, and as various changes might be made in the embodiment above set forth, it is to be understood that all matter herein set forth or shown in the accompanying drawing is to be interpreted as illustrative and not in a limiting sense.

Having thus described my invention I claim as new and desire to secure by Letters Patent:

1. A noisemaking toy device comprising: a hollow generally circular stationary base having a vertical axis; a drill rod axially disposed within said base and extending upwards therefrom; guide means in said base mounting said drill rod for axial movement between upper and lower extreme positions; spring means acting between said base and said drill rod for biasing said drill rod to said upper extreme position; a horizontal disc mounted coaxially within said base for rotation about said vertical axis; one way free wheeling clutch means coupling said drill rod and said disc for converting downward movement of said drill rod to rotational movement of said disc; a plurality of striker pins carried at angularly spaced apart locations proximate the periphery of said disc and extending perpendicular to said disc; and a plurality of elongated reed members carried at spaced apart locations on the interior of said base and extending horizontally and radially inward within said housing into the path of said striker pins.

2. The device of claim 1, wherein said reed members comprise helical springs which spiral both angularly and radially inward into the path of said striker pins.

3. The device of claim 2, wherein said one way free wheeling clutch means comprises a central well in said disc defining a ball bearing race; a plurality of ball bearings in said race; a horizontal rotary cam disposed in said well and configured for wedging said ball bearings between said cam and said race in response to only one direction of rotation of said cam whereby said cam and disc rotate as a unit in only one direction; said cam having a central opening engaged about said drill rod for converting axial movement of said drill rod to rotational movement of said cam.

* * * * *